US006607998B1

(12) United States Patent
Lambert et al.

(10) Patent No.: US 6,607,998 B1
(45) Date of Patent: Aug. 19, 2003

(54) BURNER MEMBRANE COMPRISING A NEEDLED METAL FIBRE WEB

(75) Inventors: Eddy Lambert, Deerlijk (BE); Gabriel Dewaegheneire, Zwevegem (BE)

(73) Assignee: N. V. Bekaert S.A., Zwevegem (BE)

( * ) Notice: Subject to any disclaimer, the term of this patent is extended or adjusted under 35 U.S.C. 154(b) by 0 days.

(21) Appl. No.: 09/509,427

(22) PCT Filed: Sep. 29, 1998

(86) PCT No.: PCT/EP98/06245

§ 371 (c)(1),
(2), (4) Date: Mar. 28, 2000

(87) PCT Pub. No.: WO99/18393

PCT Pub. Date: Apr. 15, 1999

(30) Foreign Application Priority Data

Oct. 2, 1997 (BE) ..... 9700792

(51) Int. Cl.[7] ..... D04H 1/00; D04H 1/46; B32B 5/06

(52) U.S. Cl. ..... 442/402; 442/327; 442/332; 442/376; 442/377; 442/380; 442/387; 442/414

(58) Field of Search ..... 442/327, 332, 442/376, 377, 380, 387, 414

(56) References Cited

U.S. PATENT DOCUMENTS

| | | | | | |
|---|---|---|---|---|---|
| 3,379,000 A | | 4/1968 | Webber et al. | 57/139 |
| 4,290,746 A | * | 9/1981 | Smith | 431/328 |
| 4,930,199 A | * | 6/1990 | Yanagisawa | 29/4.51 |
| 5,024,596 A | | 6/1991 | Smith | 431/328 |
| 5,088,919 A | * | 2/1992 | De Bruyne et al. | 431/328 |
| 5,165,887 A | * | 11/1992 | Ahmady | 431/329 |
| 5,380,580 A | * | 1/1995 | Rogers et al. | 428/219 |
| 5,524,704 A | | 6/1996 | Stouvenot et al. | 164/463 |
| 6,249,941 B1 | * | 6/2001 | Krupnik et al. | 29/4.51 |

FOREIGN PATENT DOCUMENTS

| | | | | |
|---|---|---|---|---|
| EP | 0 157 432 B1 | | 2/1985 | |
| EP | 0 157 432 A2 | | 2/1985 | |
| EP | 0 329 863 A1 | | 11/1988 | |
| EP | 0 329 863 B1 | | 11/1988 | |
| EP | 0329863 A1 | * | 11/1988 | B22F/3/04 |
| EP | 0 348 993 A2 | | 6/1989 | |
| EP | 0 390 255 B1 | | 3/1990 | |
| EP | 0 390 255 A1 | | 3/1990 | |
| WO | WO 93/18342 | * | 9/1993 | F23D/14/16 |
| WO | WO 97/04152 | | 6/1997 | |

* cited by examiner

*Primary Examiner*—Glenn Caldarola
*Assistant Examiner*—Alexis Wachtel
(74) *Attorney, Agent, or Firm*—Foley & Lardner

(57) ABSTRACT

A burner membrane has at least one layer consisting of a compressed, needled fiber web with a porosity of between 60% and 95%, and that is constructed of heat-resistant stainless steel fibers. A method for its manufacture includes the steps of providing a fiber web composed of heat-resistant stainless steel fibers, needling the fiber web, and compressing the needled fiber web to the desired porosity.

44 Claims, No Drawings

BURNER MEMBRANE COMPRISING A NEEDLED METAL FIBRE WEB

FIELD OF THE INVENTION

The invention relates to a burner membrane comprising heat-resistant stainless steel fibres.

BACKGROUND OF THE INVENTION

A number of types of burner membranes composed of heat-resistant stainless steel fibres are already known, comprising, for example, a sintered metal fibre web or a knitted metal fibre structure.

However, the use of a sintered web as a burner membrane, as described in European patent EP 0157432 (priority date:1984), displays a few drawbacks.

For example, the porosity of a sintered metal fibre web as such is often insufficiently homogeneous, so that the flow of gas through the membrane is not sufficiently uniform. The axial temperature gradient that is established through the burner membrane during burning results in a non-homogeneous thermal expansion and mechanical [stresses]. After a number of heating and cooling cycles, these stresses can lead to cracks or fissures in the membrane. These drawbacks can in part be dealt with by providing the surface of the burner membrane with a regular pattern of perforations or a grid-like pattern of grooves, such as described respectively in PCT patent application WO 93/18342 (priority date: 1992) and European patent EP 0390255 (priority date:1989), both submitted by the applicant.

Furthermore, a burner membrane composed of a sintered metal fibre web is deformable only to a limited extent, which also constitutes a significant drawback.

Knitted membranes composed of metal fibres, as described in PCT patent application WO 97/04152 (priority date:1995) of the applicant, deal to a significant extent with the aforementioned drawbacks, but their construction is relatively complicated.

SUMMARY OF THE INVENTION

It is the object of the invention to deal with the drawbacks of the aforementioned types of burner membranes and to provide a metal fibre burner membrane that possesses a high and nearly homogeneous porosity, and that is to a large extent deformable. Moreover, the membrane possesses a considerable mechanical cohesion and strength, and can be fabricated in an inexpensive and simple manner.

To this end, the invention provides a burner membrane comprising at least one layer consisting of a compressed, needled fibre web composed of heat-resistant stainless steel fibres. The porosity of the burner membrane is between 60% and 95%.

The heat-resistant stainless steel fibre bundles that are incorporated in the fibre web and that are composed, for example, of Fecralloy®, can be obtained by means of the technique of bundled drawing, as described in U.S. Pat. No. 3,379,000, or by shaving the rolled edge of a roll of metal foil, as described in U.S. Pat. No. 4,930,199, or directly from the melt, for example by extrusion, as described in U.S. Pat. No. 5,524,704.

With respect to the present invention, the better fibres are those obtained by shaving the rolled edge of a roll of metal foil, as described in U.S. Pat. No. 4,930,199. The reason is that they have not a round transversal cross-section, which allows them to be intertwined to a more coherent structure during the needling operation.

The steel fibres have an equivalent diameter of between 5 $\mu$m and 150 $\mu$m, by preference between 10 $\mu$m and 50 $\mu$m. The equivalent diameter is here defined as the diameter of an imaginary round fibre having the same cross-section as that of the real fibre in question.

Apart from this, steel wool can also be used to fabricate the fibre web.

The burner membrane according to the invention can be obtained by and the sintering step of the web can be avoided by:

a) providing a fibre web composed of heat-resistant stainless steel fibres, whether multi-layered or not;

b) needling the fibre web;

c) compressing the needled fibre web to the desired porosity, for example by means of a roller or press operation.

Compressing is done to give the desired stability to the membrane. The needled fibre web may be compressed to such a degree that cold weldings are just avoided.

A correspondingly formed burner membrane can be obtained by needling a flat, tubular, cylindrical or conical metal fibre web.

The burner membrane according to the invention has a nearly homogeneous porosity, which is between 60% and 95%, and by preference between 80% and 95%. This makes it possible to utilize large and uniform gas flows.

The weight of the burner membrane is between 400 g/m$^2$ and 4000 g/m$^2$, and is by preference between 1000 g/m$^2$ and 2500 g/m$^2$.

Needling or needle punching can be done by punching the web of metal fibres by means of a bed of needles. Due to this operation, the metal fibres are intertwined with one another, a fact which lends considerable mechanical cohesion and strength, yet does not impair the good deformability of the needled felt and yet does not lead to an unacceptable decrease in porosity. During the needling operation care must be taken not to punch twice or more times at the same spot, since this may decrease the homogeneity of the web. Moreover, the thermal expansion of the burner membrane can take place unhindered, and there is nearly no danger of cracks or fissures appearing.

A needled web of ceramic fibres for burners is known in the art, e.g. in U.S. Pat. No. 5,024,596 (priority date:1985). Needling of a web of ceramic fibres is done in order to avoid the use of a binder and to render the ceramic fibre web more pliable as a result of the avoiding of the binder. Having regard, however, to the brittleness of the ceramic fibres, the degree of compressing of a needled fibre web is very limited In order to improve the homogeneity of the gas flow even further, the burner membrane according to the invention can be perforated in a regular pattern over at least a portion of its surface, for example by mechanical means or with the aid of laser techniques.

The web formation, needling, compressing and in some cases perforating can be carried out consecutively on a single production line, which makes the manufacture of the burner membrane relatively simple and inexpensive.

The burner membrane according to the invention can also be coated with substances that activate the oxidation of the fuel mixture.

In an alternative embodiment, the needled metal fibre web, whether multilayered or not, can be pressed in a cold isostatic manner such that a smooth surface is obtained on either one or both sides of the web. The principle of cold isostatic pressing is described in European patent EP 0329863 of the applicant.

Furthermore, in addition to a needled fibre web, another metal fibre network, such as a woven or knitted fabric, can also be incorporated into the burner membrane according to the invention.

DESCRIPTION OF A PREFERRED EMBODIMENT OF THE INVENTION

EXAMPLE

A burner membrane according to the invention has been manufactured out of Fecralloy® heat-resistant stainless steel fibres having an equivalent diameter of 35 μm. Four metal fibre webs were stacked on top of one another and needled to form a multi-layered needled felt with a weight of 1580 g/m$^2$. This needled felt was placed between two stainless steel plates and rolled at a pressure of 200 bar to form a membrane with a thickness of 1.5 mm and a nearly homogeneous porosity of 85.7%.

The (flat) burner membrane thus obtained was used as a part of a surface burner for gas, and was tested in a radiation system and a blue-flame system at heat fluxes of 100 to 5000 kW/m$^2$.

The high, homogeneous porosity of the burner membrane results in a very homogeneous combustion and enables the use of large gas flows.

In addition, the burner membrane has good deformability and substantial mechanical sturdiness.

Moreover, as a result of the very open structure of the burner membrane, no filter is required for the gas mixture which is to be burned.

The chance of flame resonance is very small, so that, among other things, the disturbance of whistling sounds is avoided.

Furthermore, the burner membrane according to the invention offers good resistance to flashback, both with sub- and super-stoichiometric combustion of (for example) methane, ethane, propane and butane, or of gases containing hydrogen and/or carbon monoxide.

Moreover, the burner membrane according to the invention offers the advantage that the required time span for warming up or cooling off is extremely short, so that a very great variation in heat flux can be realized in a very short time (order of magnitude of seconds). Hence the changeover from one combustion system to another occurs very smoothly and the cooling off time is very short. This quick response is very advantageous from the point of view of safety.

What is claimed is:

1. Burner membrane comprising at least one layer consisting of a needled fiber web which is compressed to a porosity of between 60% and 95%, and that is constructed of heat-resistant stainless steel fibers, wherein the fiber web is needled in one step and compressed in a different step, further comprising one of a woven and knitted fabric.

2. Burner membrane according to claim 1, in which the porosity of the needled fiber web is between 80% and 95%.

3. Burner membrane according to claim 1, in which the fiber web consists of steel fibers having an equivalent diameter of between 5 μm and 150 μm.

4. Burner membrane according to claim 3, in which the fiber web consists of steel fibers having an equivalent diameter of between 10 μm and 50 μm.

5. Burner membrane according to claim 1, in which the weight of the fiber web is between 400 g/m$^2$ and 4000 g/m$^2$.

6. Burner membrane according to claim 5, in which the weight of the fiber web is between 1000 g/m$^2$ and 2500 g/m$^2$.

7. Burner membrane according to claim 1, which is provided with a regular pattern of perforations over at least a portion of its surface.

8. Burner membrane according to claim 1, wherein said steel fibers are obtained by shaving the rolled edge of a roll of metal foil.

9. Method of manufacturing a burner membrane according to claim 1, comprising the following steps:

(a) providing a fiber web composed of metal fibers;

(b) needling the fiber web;

(c) compressing the needled fiber web to said porosity.

10. Burner membrane comprising at least one layer comprising a needled fiber web which is compressed to a porosity of between 60% and 95%, and which comprises heat-resistant stainless steel fibers, wherein the fiber web is needled in one step and compressed in a different step, further comprising one of a woven and knitted fabric incorporated into the burner membrane.

11. Burner membrane according to claim 10, in which the porosity of the needled fiber web is between 80% and 95%.

12. Burner membrane according to claim 10, in which the fiber web comprises steel fibers having an equivalent diameter of between 5 μm and 150 μm.

13. Burner membrane according to claim 12, in which the fiber web comprises steel fibers having an equivalent diameter of between 10 μm and 50 μm.

14. Burner membrane according to claim 10, in which the weight of the fiber web is between 400 g/m$^2$ and 4000 g/m$^2$.

15. Burner membrane according to claim 14, in which the weight of the fiber web is between 1000 g/m$^2$ and 2500 g/m$^2$.

16. Burner membrane according to claim 10, which is provided with a regular pattern of perforations over at least a portion of its surface.

17. Burner membrane according to claim 10, wherein said steel fibers are obtained by shaving the rolled edge of a roll of metal foil.

18. Method of manufacturing a burner membrane according to claim 10, comprising the following steps:

(a) providing a fiber web comprising metal fibers;

(b) needling the fiber web, (c) compressing the needled fiber web to said porosity; and (d) incorporating one of a woven and knitted fabric into the burner membrane.

19. Method for avoiding a sintering operation in the manufacture of a burner membrane, said method comprising the following steps;

(a) providing a fiber web comprising metal fibers;

(b) needling the fiber web;

(c) compressing the needled fiber web to a desired porosity to form a burner membrane, wherein the compressing step is not performed in the needling step;

(d) incorporating one of a woven and knitted fabric into the burner membrane;

(e) wherein the membrane is not sintered.

20. Method according to claim 19, wherein the compressing of the needled fiber web is done to such a degree that cold weldings between the individual fibers are avoided.

21. Method according to claim 19, wherein compressing the needled fiber web is performed by one of a roller and press operation.

22. Method according to claim 19, wherein providing a fiber web comprises providing one of a tubular, cylindrical, and conical fiber web.

23. Method according to claim 19, further comprising perforating the fiber web in a regular pattern over at least a portion of its surface.

24. Method according to claim 19, wherein compressing the needled fiber web comprises pressing the needled fiber web in a cold isostatic manner.

25. Method according to claim 19, wherein the desired porosity is between approximately 80% and 95%.

26. Method according to claim 19, wherein the fiber web comprises heat-resistant stainless steel fibers having an equivalent diameter of between approximately 10 $\mu$m and 50 $\mu$m.

27. Method according to claim 19, wherein the fiber web comprises heat-resistant stainless steel fibers, and wherein a weight of the burner membrane is between approximately 1000 g/m$^2$ and 2500 g/m$^2$.

28. Method according to claim 19, wherein said porosity is substantially homogeneous throughout the needled fiber web.

29. Burner membrane according to claim 10, wherein the needled fiber web is formed from one of a tubular, cylindrical, and conical fiber web.

30. Burner membrane according to claim 10, wherein the needled fiber web is compressed in a cold isostatic manner.

31. Burner membrane according to claim 10, wherein the needled fiber web is compressed by one of a roller and press operation.

32. Burner membrane according to claim 10, wherein said porosity is substantially homogeneous throughout the needled fiber web.

33. Burner membrane according to claim 1, wherein substantially all of the volume of the burner membrane is in a compressed state.

34. Burner membrane according to claim 10, wherein substantially all of the volume of the burner membrane is in a compressed state.

35. Burner membrane according to claim 19, wherein the compressing step leaves substantially all of the volume of the burner membrane in a compressed state.

36. Method according to claim 18, wherein the compressing of the needled fiber web is done to such a degree that cold weldings between the individual fibers are avoided.

37. Method according to claim 18, wherein compressing the needled fiber web is performed by one of a roller and press operation.

38. Method according to claim 18, wherein providing a fiber web comprises providing one of a tubular, cylindrical, and conical fiber web.

39. Method according to claim 18, further comprising perforating the fiber web in a regular pattern over at least a portion of its surface.

40. Method according to claim 18, wherein compressing the needled fiber web comprises pressing the needled fiber web in a cold isostatic manner such that a smooth surface is obtained on at least one side of the needled fiber web.

41. Method according to claim 18, wherein the desired porosity is between approximately 80% and 95%.

42. Method according to claim 18, wherein the fiber web comprises heat-resistant stainless steel fibers having an equivalent diameter of between approximately 10 $\mu$m and 50 $\mu$m.

43. Method according to claim 18, wherein the fiber web comprises heat-resistant stainless steel fibers, and wherein a weight of the burner membrane is between approximately 1000 g/m$^2$ and 2500 g/m$^2$.

44. Method according to claim 18, wherein said porosity is substantially homogeneous throughout the needled fiber web.

* * * * *